United States Patent [19]

Swanson

[11] 4,009,594

[45] Mar. 1, 1977

[54] HOT GAS DEFROSTING APPARATUS

[75] Inventor: Donald F. Swanson, St. Paul, Minn.

[73] Assignee: Whirlpool Corporation, Benton Harbor, Mich.

[22] Filed: June 2, 1975

[21] Appl. No.: 582,909

[52] U.S. Cl. ..... 62/278; 62/81; 62/196 B

[51] Int. Cl.² ..... F25D 21/06

[58] Field of Search ..... 62/174, 151, 81, 278, 62/196, 352

[56] References Cited

UNITED STATES PATENTS

| | | | |
|---|---|---|---|
| 2,627,730 | 2/1953 | Zearfoss, Jr. | 62/278 |
| 3,131,549 | 5/1964 | Rhea | 62/511 X |
| 3,338,065 | 8/1967 | Ashley | 62/174 X |
| 3,511,060 | 5/1970 | Bodcher | 62/278 X |
| 3,822,562 | 7/1974 | Crosby | 62/278 X |
| 3,827,483 | 8/1974 | Hopkinson | 62/507 |
| 3,838,582 | 10/1974 | Redfern et al. | 62/196 |

*Primary Examiner*—William E. Wayner
*Attorney, Agent, or Firm*—Wegner, Stellman, McCord, Wiles & Wood

[57] ABSTRACT

A refrigeration apparatus having a refrigerant fluid accumulator providing a supercharge of hot refrigerant in the system for improved defrosting at desired intervals. During the normal refrigeration operation of the apparatus, the supercharge fluid is stored in the accumulator as hot refrigerant liquid with the remaining refrigerant fluid in the system defining a full charge quantity for normal proper operation of the refrigeration apparatus. The additional refrigerant fluid further provides accelerated cooling of the evaporator of the apparatus upon initiation of the refrigeration operation subsequent to a defrosting operation for further improved efficiency of operation of the refrigeration apparatus.

13 Claims, 2 Drawing Figures

HOT GAS DEFROSTING APPARATUS

BACKGROUND OF THE INVENTION

1. Field of the Invention

This invention relates to refrigeration apparatus and in particular to means for defrosting such apparatus.

2. Description of the Prior Art

In one improved form of ice maker-type of refrigeration apparatus illustrated in my U.S. Pat. No. 3,230,736, owned by the assignee hereof, a slab of ice is formed on an evaporator structure over which water is circulated to build up the desired slab. Upon completion of the formation of the slab, which may be determined by suitable sensors or other suitable means, the flow of water is terminated and the evaporator is heated to free the formed slab therefrom, permitting it to pass onto a grid means for cutting the slab into desired smaller cubes.

The evaporator may be heated during the slab removal defrosting operation by suitable means.

One conventional method of defrosting an evaporator comprises operating the refrigeration system reversely so as to provide hot refrigerant gas to the evaporator rather than to the condenser to which the hot refrigerant is delivered in the normal refrigeration operation of the system. The present invention is concerned with an improved means for effecting such hot gas defrosting, or heating, of an evaporator in such a refrigeration system.

Another form of such slab ice maker apparatus is shown in U.S. Pat. No. 2,747,375 of Joseph R. Pichler. In said patent, a bypass line is provided for conducting refrigerant fluid from a receiver through a solenoid valve to the evaporator. The receiver is connected to the condenser. The refrigeration apparatus comprises an expansion valve apparatus wherein an expansion valve is provided in the conduit leading from the receiver with a thermostatic control thereon with the expansion valve controlling the flow of refrigerant to the evaporator during normal operation of the system. A second valve is provided in a second conduit leading to the evaporator for bypassing the expansion valve during a defrosting operation. The refrigeration fluid is provided to the evaporator from the receiver during both the refrigeration and defrosting cycles.

In the U.S. Pat. No. 3,338,065, of Carlyle M. Ashley, an accumulator is provided for storing refrigerant fluid to be provided to the condenser during a defrosting operation. Refrigerant flow from the accumulator is limited by a restrictor to permit the condenser to completely vaporize the liquid delivered from the accumulator before delivery thereof to the evaporator.

SUMMARY OF THE INVENTION

As indicated briefly above, the present invention is concerned with the defrosting, or heating, of the evaporator and comprehends providing a supercharge of refrigerant fluid into the system during the defrosting operation. The invention more specifically comprehends providing an accumulator which stores the excess refrigerant fluid within the system in liquid form with the remaining refrigerant fluid comprising a full charge quantity for normal refrigeration operation of the system.

The accumulator is connected between the compressor and the evaporator so that during the defrosting, or heating, operation, the compressor may effect delivery of the stored refrigerant directly to the evaporator together with any additional hot compressed gas delivered from the compressor at that time.

The refrigerant fluid from the accumulator may be delivered into the inlet of the evaporator, bypassing the flow restricting means normally provided between the condenser and the evaporator whereby the compressor functions during the defrost operation to provide delivery directly to the evaporator from the accumulator rather than through the condenser and flow restricting means.

The accumulator is preferably cooled to effect the desired liquefying of the hot refrigerant gas delivered thereto from the compressor during the normal refrigeration operation of the system. The cooling means may comprise the means for cooling the compressor and/or cooling the condenser.

Flow of the hot refrigerant liquid from the accumulator to the evaporator may be controlled by a suitable valve in the duct between the accumulator and the evaporator. In the illustrated embodiment, the accumulator is in flow transfer communication with the compressor at all times.

The improved defrosting means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
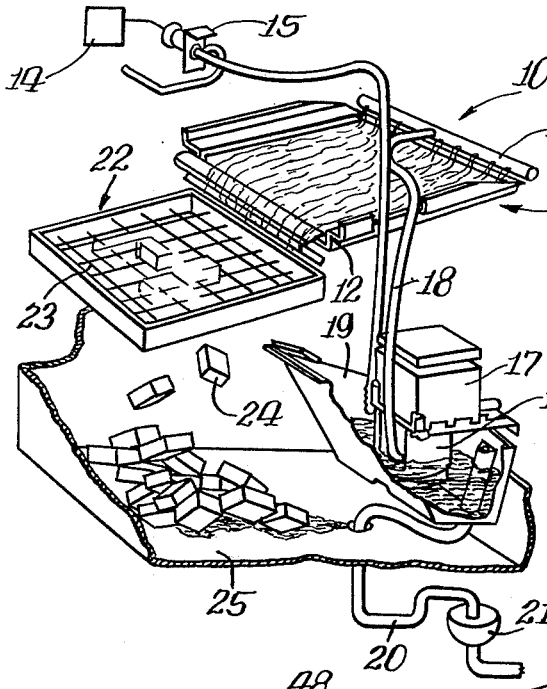
FIG. 1 is a fragmentary perspective view of a refrigeration apparatus having a hot gas heating means embodying the invention.

In the exemplary embodiment of the invention as disclosed in the drawing, a refrigeration apparatus generally designated 10 is shown to comprise an ice maker having an evaporator 11. Water is circulated over an upper surface 12 of the evaporator from a distributor 13 to build up a slab of ice on the surface 12. The water may be delivered from a pressurized water supply 14 through a supply valve 15 to a reservoir tank 16. The water is circulated in the apparatus by means of a pump 17 directing the water into distributor 13 through a duct 18 and receiving the returned water in a sump 19. Upon the completion of each ice making cycle, the remaining water may be dumped from the sump 19 through a discharge tube 20 to a drain 21.

As further shown in FIG. 1, the ice maker apparatus may include a grid structure 22 provided with selectively heated wires 23. Upon completion of the formation of the ice slab, it is freed from the evaporator surface 12 by a heating of the evaporator. Surface 12 is suitably inclined toward grid 22 to cause the freed slab to slide downwardly onto the grid where the heated wires function to cut the slab into a plurality of smaller cubes generally designated 24 which drop from the grid into a subjacent collecting bin 25.

Such ice makers are commonly referred to as "commercial" ice makers in that large quantities of ice may be made quickly and efficiently by such apparatus. In such applications, it is desirable to maximize the efficiency of ice production and, thus, it is desirable to minimize the length of time necessary to heat the evaporation to free the ice slab therefrom and to return the evaporator to a water-freezing condition upon release of the slab therefrom onto the grid. The present invention comprehends improved means for effecting this desideratum.

Figure 2:
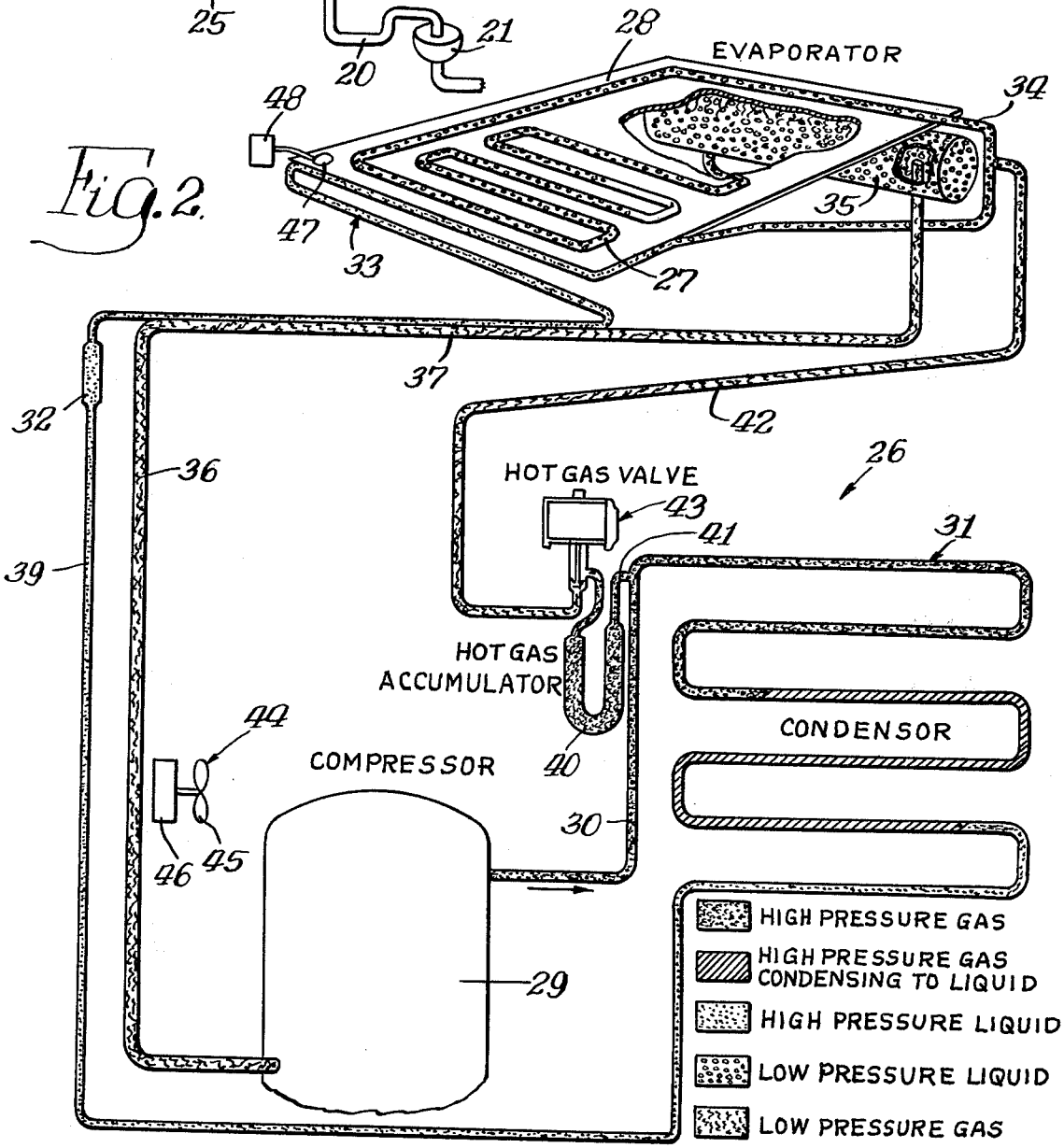
FIG. 2 is a schematic flow diagram illustrating the heating means of the invention.

More specifically, as seen in FIG. 2, the means generally designated 26 for refrigerating the evaporator comprises an evaporator coil 27 in thermal transfer association with the freezing plate 28 of the evaporator. Refrigerant fluid is provided to the evaporator coil by a compressor 29 which compresses the low pressure refrigerant fluid returned from the evaporator and delivers it through a discharge duct 30 to a condenser 31, a dryer 32, and a flow restricting means 33 to an inlet 34 of the evaporator coil. In the illustrated embodiment, the flow restricting means comprises a capillary tube.

Refrigerant fluid expanding in the evaporator coil 27 effectively cools the freezing plate 28 and passes into an accumulator 35. This refrigerant gas is then delivered through a suction line 36 to the compressor 29 for recompression and recirculation to the evaporator, as discussed above. The suction line may have a portion 37 in heat exchange relationship with a portion 38 of the delivery line 39 extending between condenser 31 and capillary tube 33, as shown in FIG. 2.

The invention comprehends providing a hot gas accumulator generally designated 40 in fluid transfer association with compressor discharge line 30 and evaporator inlet 34. More specifically, as shown in FIG. 2, the accumulator 40 may be connected to discharge line 30 by a connecting duct 41 and to the evaporator inlet 34 by a connecting duct 42 provided with a solenoid valve 43.

Air flow means generally designated 44 may be provided for cooling the hot gas accumulator 40 and illustratively may comprise a fan 45 driven by a suitable electric motor 46. The air flow means may comprise the cooling fan means for the compressor 29 and/or the cooling fan means for the condenser 31.

During the ice forming, or refrigeration, operation of the apparatus, refrigerant gas is delivered from condenser 31 to the evaporator as discussed above. After absorbing heat from the evaporator plate 28, the refrigerant gas is delivered through the accumulator 35 and return duct 36 back to the compressor for recompression thereof and delivery to the condenser 31 for reliquefication thereof in a conventional refrigeration manner.

The present invention comprehends the provision of a supercharge of refrigerant fluid in the refrigeration system. During the refrigeration operation, a portion of the hot compressed gas delivered through discharge duct 30 of the compressor is diverted into the hot gas accumulator 40 which is open to the discharge line 30 at all times through the connecting duct 41. During the refrigeration operation, valve 43 is closed, and, thus, refrigerant fluid is accumulated in accumulator 40. The cooling action of fan 44 liquefies the hot compressed gas in accumulator 40 so that prior to the completion of the refrigeration operation in forming the ice slab, the accumulator is filled with hot refrigerant liquid. The quantity of such liquid filling the accumulator comprises an excess refrigerant fluid in the system with the remaining refrigerant fluid comprising a full charge of refrigerant for providing conventional normal operation of the system as discussed above. A further advantage of the accumulator is that its storage capacity for refrigerant during the normal operating cycle reduces the criticality of the amount of the refrigerant charge from ± ½ ounce to more than ± 3 ounces which greatly facilitates the manufacture and/or repair of the ice maker.

Release of the ice slab from the evaporator plate 28 is effected by the opening of valve 43 while concurrently terminating operation of pump 17 and fan means 44. At this time, the mineral-rich remaining water of the previous ice slab forming cycle may be dumped from the sump 19 and a fresh charge of water delivered into the system through the valve 15 from the water supply 14 for use in the subsequent ice slab forming cycle.

Opening of valve 43 permits the hot pressurized refrigerant fluid delivered from compressor 29 through discharge duct 30 to now force the hot refrigerant liquid from accumulator 40 through the connecting duct 42 and inlet 34 into the evaporator coil 27 for heating the evaporator plate 28 to release the slab from the evaporator onto the cube-forming grid 22, as discussed above.

As the transfer duct 42 effectively bypasses the flow restricting means 33, connecting duct 42 is effectively at a low pressure as it is in more direct flow transfer association with the suction line 36 to the compressor. Thus, at the start of the defrost cycle, the hot liquid refrigerant in the accumulator flows into the evaporator in the form of a mixture of hot liquid and hot gas which condenses in and warms the relatively cold evaporator coil 27, thereby to heat the evaporator for releasing the ice slab. As the defrost cycle continues, hot gas from the compressor is supplied to the evaporator to continue the heating thereof through the accumulator.

Control of the operation of the apparatus may be effected by a suitable ice thickness sensor 47 which senses the thickness of the ice slab so as to initiate and terminate the slab releasing heat operation. When the ice thickness sensor determines that the slab has been released from the evaporator, suitable control means 48 associated with sensor 47 effects the closing of valve 43 and initiates operation of the fan means 44 and pump means 17 to initiate a new refrigeration cycle wherein a subsequent slab of ice is formed on the evaporator surface 12. At this time, the refrigeration system is supercharged as the refrigerant previously stored in the accumulator 40 as liquid refrigerant is now incorporated with the main body of refrigerant in the system. Thus, accelerated cooling of the evaporator is effected by virtue of the supercharged condition of the system upon the initiation of the refrigeration cycle.

The supercharged condition is gradually dissipated by the delivery of the hot compressed gas from compressor 29 to the accumulator 40, as discussed above. When, as discussed above, the accumulator is again filled with hot liquid refrigerant, further operation of the system is under the normal fully charged condition for conventional normal operation of the ice maker in completing the refrigeration cycle.

Thus, it may be seen that not only does the present invention provide an improved rapid heating of the evaporator to free the ice body, but also provides an improved rapid restoration of the evaporator to a freezing condition after the ice body is freed so as to minimize the time necessary to release a formed slab and initiate the formation of a subsequent slab. As discussed above, particularly in commercial applications, such increase in the efficiency of the operation of the ice maker is highly desirable. The present invention provides this desideratum with a simple, low cost additional accumulator means, as discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having an evaporator, a compressor, means for delivering refrigerant fluid from the evaporator to the compressor, a condenser, and flow passage means for delivering cooled liquefied refrigerant fluid from the condenser to the evaporator including a capillary tube restrictor, the improvement comprising: means defining an accumulator chamber connected in parallel with said condenser between said compressor and evaporator; delivery means for delivering hot compressed refrigerant fluid from the compressor to the condenser and said chamber during a cooling operation of the apparatus; and controlled means for causing the hot compressed refrigerant fluid delivered to said chamber to be stored therein as a liquid during refrigeration operation of said apparatus and the stored refrigerant liquid to be delivered from said accumulator chamber to said evaporator as a result of continued delivery of hot compressed refrigerant fluid from the compressor for heating the evaporator during a heating operation of the apparatus.

2. The refrigeration apparatus of claim 1 wherein said controlled means includes duct means connecting said accumulator chamber to said evaporator, and valve means for selectively closing said duct means.

3. The refrigeration apparatus of claim 1 wherein said controlled means delivers the hot compressed refrigerant fluid to the evaporator downstream of said flow restrictor.

4. The refrigeration apparatus of claim 1 wherein said accumulator chamber means comprises a U-shaped tube.

5. The refrigeration apparatus of claim 1 wherein said delivery means comprises an outlet duct leading from said compressor, first branch duct means for directing hot compressed refrigerant fluid from said outlet duct to said condenser, and second branch duct means for directing hot compressed refrigerant fluid from said outlet duct to said accumulator chamber.

6. In a refrigeration apparatus having an evaporator, a compressor, means for delivering refrigerant fluid from the evaporator to the compressor, a condenser, and flow passage means for delivering cooled liquefied refrigerant fluid from the condenser to the evaporator including a capillary tube restrictor, the improvement comprising: means defining an accumulator chamber connected in parallel with said condenser between said compressor and evaporator; delivery means for delivering hot compressed refrigerant fluid from the compressor to the condenser and said chamber during a cooling operation of the apparatus; controlled means for causing the hot compressed refrigerant fluid delivered to said chamber to be stored therein during refrigeration operation of said apparatus and the stored refrigerant fluid to be delivered from said accumulator chamber to said evaporator as a result of the continued delivery of hot compressed refrigerant fluid thereto by said compressor for heating the evaporator during a heating operation of the apparatus; and means for cooling the hot refrigerant fluid in said accumulator chamber during said cooling operation to condense gaseous refrigerant fluid therein for delivery therefrom to said evaporator as a liquid.

7. The refrigeration apparatus of claim 6 wherein said means for cooling the hot refrigerant fluid in said accumulator comprises means for cooling said compressor.

8. The refrigeration apparatus of claim 6 wherein said means for cooling the hot refrigerant fluid in said accumulator comprises means for cooling said condenser.

9. The refrigeration apparatus of claim 6 wherein said delivery means comprises means for delivering hot refrigerant gas from the compressor to the accumulator during said heating operation of the apparatus.

10. In a refrigeration apparatus having an evaporator, a preselected charge of refrigerant fluid, a compressor, means for delivering refrigerant fluid from the evaporator to the compressor, a condenser, and flow passage means for delivering cooled liquefied refrigerant fluid from the condenser to the evaporator including a capillary tube restrictor, the improvement comprising: means defining an accumulator chamber connected in parallel with said condenser between said compressor and evaporator; delivery means for delivering hot compressed refrigerant fluid from the compressor to the condenser and said chamber during a cooling operation of the apparatus; and controlled means for causing the hot compressed refrigerant fluid delivered to said chamber to be stored as liquid refrigerant fluid therein during refrigeration operation of said apparatus and the stored refrigerant liquid to be delivered from said accumulator chamber to said evaporator as a result of the continued delivery of hot compressed refrigerant fluid thereto by said compressor for heating the evaporator during a heating operation of the apparatus, said charge of refrigerant fluid being preselected to cause the apparatus to be fully charged for refrigeration operation with said accumulator chamber being full of liquid refrigerant fluid.

11. The refrigeration apparatus of claim 10 wherein said controlled means comprises means for causing delivery to said evaporator of hot gaseous refrigerant fluid from the compressor and liquid refrigerant fluid from the accumulator chamber during said heating operation.

12. The refrigeration apparatus of claim 10 wherein said controlled means causes refilling of the accumulator chamber with liquid refrigerant fluid upon reinitiation of a refrigeration operation subsequent to completion of a heating operation, said preselected refrigerant fluid being sufficient to cause said condenser to be filled with liquid refrigerant fluid during said reinitiation of refrigeration operation.

13. The refrigeration apparatus of claim 10 wherein said accumulator chamber is in fluid transfer association with said compressor at all times.

* * * * *

UNITED STATES PATENT AND TRADEMARK OFFICE

CERTIFICATE OF CORRECTION

PATENT NO. : 4,009,594

DATED : March 1, 1977

INVENTOR(S) : Donald F. Swanson

It is certified that error appears in the above-identified patent and that said Letters Patent are hereby corrected as shown below:

Column 6, Claim 12, line 59 after "fluid" insert the word --charge--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*